United States Patent [19]

Liljas et al.

[11] 4,078,920

[45] Mar. 14, 1978

[54] AUSTENITIC STAINLESS STEEL WITH HIGH MOLYBDENUM CONTENT

[75] Inventors: Mats Liljas, Avesta; Jan Ingemar Fridberg, Hallefors; Hasse Sigverd Fredriksson, Stockholm, all of Sweden

[73] Assignee: Avesta Jernverks Aktiebolag, Avesta, Sweden

[21] Appl. No.: 763,598

[22] Filed: Jan. 28, 1977

[30] Foreign Application Priority Data

Feb. 2, 1976 Sweden ..... 7601070

[51] Int. Cl.[2] ..... C22C 38/06; C22C 38/42; C22C 38/44

[52] U.S. Cl. ..... 75/124; 75/122; 75/125; 75/128 A; 75/128 E; 75/128 F; 75/128 N; 75/128 G; 75/128 Z; 75/128 T; 75/128 W; 75/128 V

[58] Field of Search ..... 75/128 W, 128 N, 122, 75/125, 128 E, 124, 128 F, 128 A, 128 G, 128 Z, 128 T, 128 V; 148/38

[56] References Cited

U.S. PATENT DOCUMENTS

| | | | |
|---|---|---|---|
| 2,398,702 | 4/1946 | Fleischmann | 75/128 W |
| 3,547,625 | 12/1970 | Bieber et al. | 75/128 W |
| 3,716,354 | 2/1973 | Reen | 75/128 W |
| 3,726,668 | 4/1973 | Baumel | 75/128 W |
| 3,900,316 | 8/1975 | Forbos-Jones | 75/125 |
| 4,007,038 | 2/1977 | Deverell | 75/128 W |

*Primary Examiner*—Arthur J. Steiner
*Attorney, Agent, or Firm*—Brumbaugh, Graves, Donohue & Raymond

[57] ABSTRACT

An austenitic stainless steel alloy having a high molybdenum content consisting essentially of up to 0.08% carbon, 0.01–0.8% silicon, 0.2–2.0% manganese, 17–25% chromium, 15–21% nickel, 6–10% molybdenum, 0.06–0.25% nitrogen and 0–2.0% copper and the balance of the contents of said alloy being iron with residual impurities. The alloys of the present invention have improved corrosion resistance and improved hot and cold ductility.

9 Claims, 2 Drawing Figures

AUSTENITIC STAINLESS STEEL WITH HIGH MOLYBDENUM CONTENT

Figure 1:
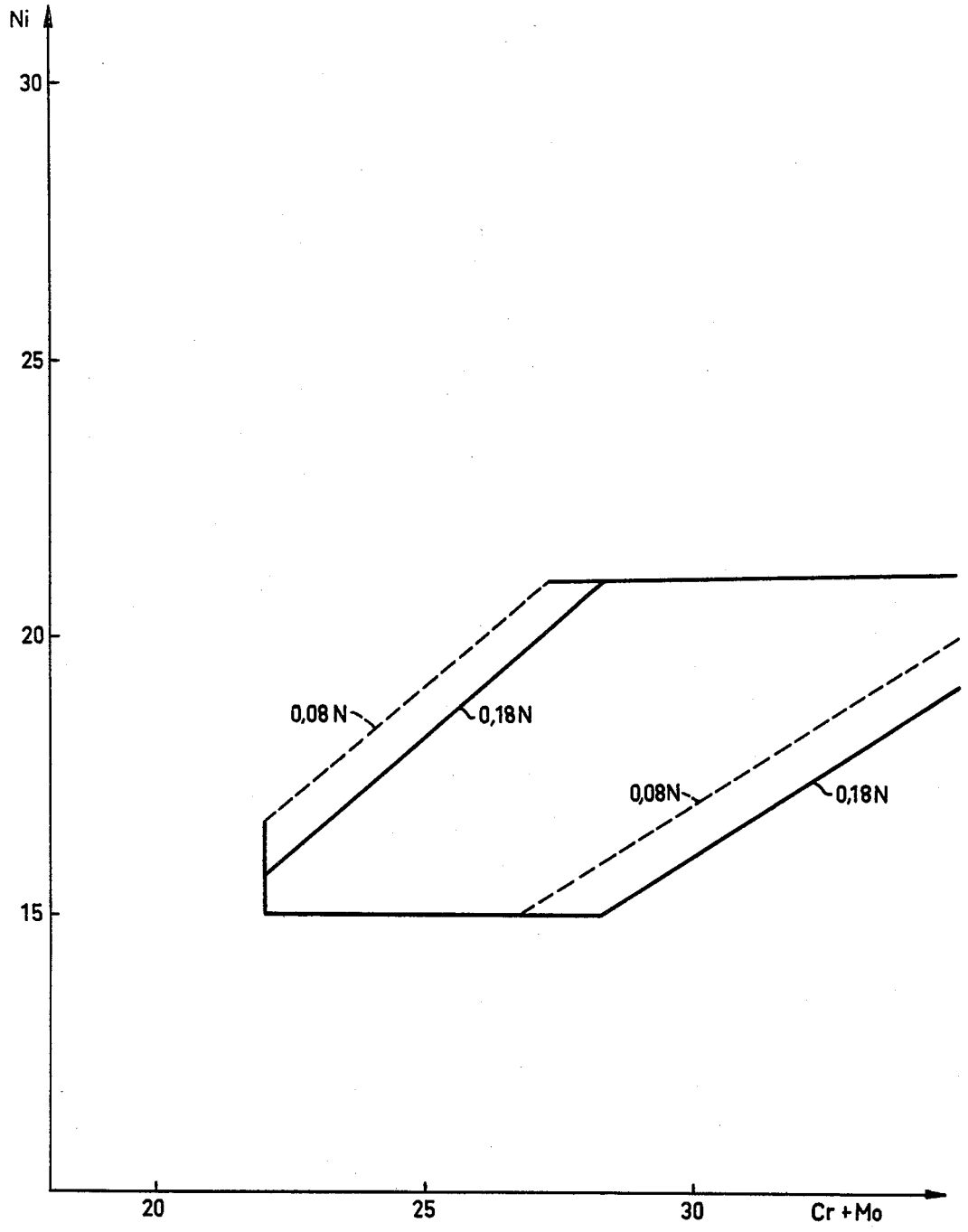

The chemical industry demands stainless steels with increasingly higher chemical resistance. A great number of more or less expensive alloys have been developed to meet these demands. The cheapest alternative generally are iron-base alloys, if they can be made sufficiently chemically resistant. It is a well-known fact that in this respect molybdenum has a favourable effect on the general corrosion and pitting corrosion resistance of stainless steels. There is, therefore, a tendency of developing steels with increasingly higher molybdenum contents, and austenitic steels at present being tested contain more than 5% molybdenum.

All of the high-molybdenum alloys commercially available or being introduced to-day are characterized by a relatively high nickel content, which normally amounts to 25–40 percent by weight. The generally high content of alloying elements, and particularly the high molybdenum content, in these steels give rise to manufacturing problems due to the reduced hot workability. The reject percentage due to crack formation at the rolling of the material is high, and the yield consequently is low.

The reduction in hot workability at high molybdenum content applies especially to the austenitic stainless steels, because their hardness increases because of the high content of alloying elements and because molybdenum lowers the diffusion coefficient and also obstructs recrystallization. Embrittling phases, moreover, such as e.g. sigma-phase, give rise to an increased cracking tendency of the material. However, after a very extensive research work it was now found possible to produce a stainless steel, which to a high degree meets the chemical industry's requirements on high chemical resistance and at the same time has good hot workability. The starting material has been a commercial fully austenitic steel with 20% Cr, 25% Ni and 4,5 Mo. It is a high-alloy steel with high corrosion resistance, but difficult to roll. Due to the high Ni-content, primarily austenite is at solidification precipitated from the melt. Cr and particularly Mo are thereby increasingly concentrated in the melt, and at the end of the solidification an interdendritic precipitation of $\delta$ -ferrite is obtained which at lower temperatures transforms by eutectoid reaction to $\delta + \gamma$ - phase. Molybdenum broadens the existence range of the $\delta$ -phase toward higher temperatures, and even in the hot-worked structure $\delta$ -phase can be precipitated in the grain boundaries. As already mentioned, the brittleness of the $\delta$ -phase is one of the reasons why this steel type is relatively difficult to roll. In spite of these difficulties, it was deemed worthwhile and interesting from a corrosion point of view to examine the possibility of increasing the Mo-content in austenitic steels still more. It was hereby found, that of the tested steels according to Table 1 below the steels with high Ni-content showed a completely austenitic solidification, while steels with low Ni-content solidified with a primary precipitation of ferrite from the heat, which resulted in less segregations. An interesting effect, which had not been observed previously on Cr-Ni-steels, was that a steel with Ni-contents in an intermediate interval solidifies by simultaneously precipitating ferrite and austenite from the melt.

The present invention, which relates to an austenitic stainless steel with high molybdenum, chromium and nickel contents and good hot workability and corrosion resistance, and which steel, besides, has a low carbon content and normal to high contents of manganese, silicon, copper and nitrogen, the remainder being iron with usual impurity substances, takes advantage of the said solidification process. Said steel is characterized thereby that it contains:

| | preferably: |
|---|---|
| from traces up to 0.080% C | 0.005–0.030% |
| 0.2-2.0% Mn | 0.2–1.0% |
| 0.1–0.8% Si | 0.3–0.5% |
| 0.06–p39p p31p p38p | |
| 17-- 0.25% N | 0.06–0.22% |
| 17 25% Cr | |
| 6.0–10.0% Mo | |
| 0–2% Cu | 0.4–1.2% |

and an optimum of Ni between 15% and 21% so adjusted in relation to the remaining additions that the alloy solidifies as austentite-ferrite from the liquid phase. In order to bring about the above solidification sequence the analysis of the steel according to the invention shall also meet the requirements as follows:

$$1.2 < \frac{\%\ Cr + \%\ Mo + 1.5\%\ Si}{\%\ Ni + 0.5(\%\ Cu + \%\ Mn) + 30\%\ C + 10\%\ N} < 1.6 \quad (1)$$

Description of Additions

Carbon contents exceeding 0.03% in unstabilized steels are to be avoided because of their unfavourable influence on the corrosion resistance. For manufacturing reasons, however, it is not always possible to keep the carbon content in the steel below 0.03%, and therefore a maximum content of 0.080% can be accepted.

Manganese is added in an amount of at least 0.2% in order not to jeopardize the hot workability and welding properties. The content, however, is maximized to 2.0%, preferably to 1.0%, because high manganese contents have a tendency of deteriorating the pitting properties of this steel type.

The silicon content normally does not fall below 0.1%, but a slightly lower content of e.g. 0.05% Si is permissible. A rather low level of 0.3–0.5% is preferred in view of the tendency of silicon to promote the precipitation of intermetallic phases. For these reasons, the permissible maximum content is 0.8%

Nitrogen is an essential alloying element in the present invention, because it has a high capacity of stabilizing the austenitic structure without affecting the solidification to as high a degree. Its effect is considered small at a content below 0.06%, while contents above 0.25% give rise to casting problems. The limits, therefore, have been set to 0.06–0.25%, but preferably are 0.06–0.22%.

Chromium is the primary addition for rendering the steel corrosion resistant. Contents below 17% are not sufficient for obtaining a stainless steel with good corrosion properties. At high chromium contents the risk of precipitation of ferrite and sigma-phase increases, and the content, therefore, should not exceed 25%, even if it were desirable.

As already mentioned, molybdenum has a very favourable effect by reducing the risk of pitting and by increasing the corrosion resistance in non-oxydizing acids. Tests have shown that a marked improvement takes place when the content exceeds 5%. From a manufacturing aspect, however, the problems increase substantially with the molybdenum content, and a practical upper limit, therefore, is 10%.

Additions of copper up to 2% have proved to improve the corrosion resistance in certain acids. In stainless steels with high molybdenum content a maximum effect is obtained within a relatively narrow content range, preferably 0.4–1.2%. The effect of copper on the remaining properties is insignificant.

Nickel is the main addition for bringing about an austenitic structure of the steel. The invention is characterized thereby that the nickel content, besides, is utilized for controlling the solidification so that austenite and ferrite crystallize from the melt simultaneously. In order to achieve this, the nickel content must be adjusted in relation to other additions so as to satisfy the above equation (1). The nickel limits thus obtained are 15–21%.

An addition of mish metal corresponding to a cerium content of at maximum 0.10%, preferably 0.01–0.06%, has shown to additionally improve the hot workability of the material.

The stainless steel according to the invention having the aforesaid basic analysis may possibly contain one or both of the following additions in order to improve the workability in a similar way.

0.01–0.3% Al 0.0001–0.01% B

Besides, one or more carbide forming elements such as Nb, Ta, Ti, V, W and Zr may be added in a total amount not exceeding 1%.

The aforesaid solidification has proved to result in a segregation picture, which with respect to hot working is substantially more favourable than at a fully austenitic solidification. In order to determine the hot workability of Cr-Ni-Mo steels with different analyses, tensile tests at elevated temperatures were carried out with material in cast state. Tensile test at elevated temperatures, as a matter of fact, has proved a suitable laboratory test method for determining how the material will behave at large-scale hot working operations.

The analyses of the tested alloys are apparent from Table 2 below. The tests were carried out in the temperature interval 1000°–1300° C. with a strain rate of about 100%/s. The reduction of area was used as a measure of hot ductility.

In order to elucidate the invention still more, it is described below with reference to the accompanying drawings, in which FIG. 1 is a diagram showing the content range for some steels according to the invention, and FIG. 2 in form of a diagram shows the result of tensile tests at elevated temperatures for some steels according to the invention.

FIG. 1 illustrates the content range for a steel according to the invention containing Si = 0.2%

Mn = 0.5%

C = 0.02%

Cu = 0.5%

N = 0.08–0.18% and contents of Cr + Mo varying according to the scale indicated on the abscissa and of Ni according to the scale on the ordinate.

Figure 2:
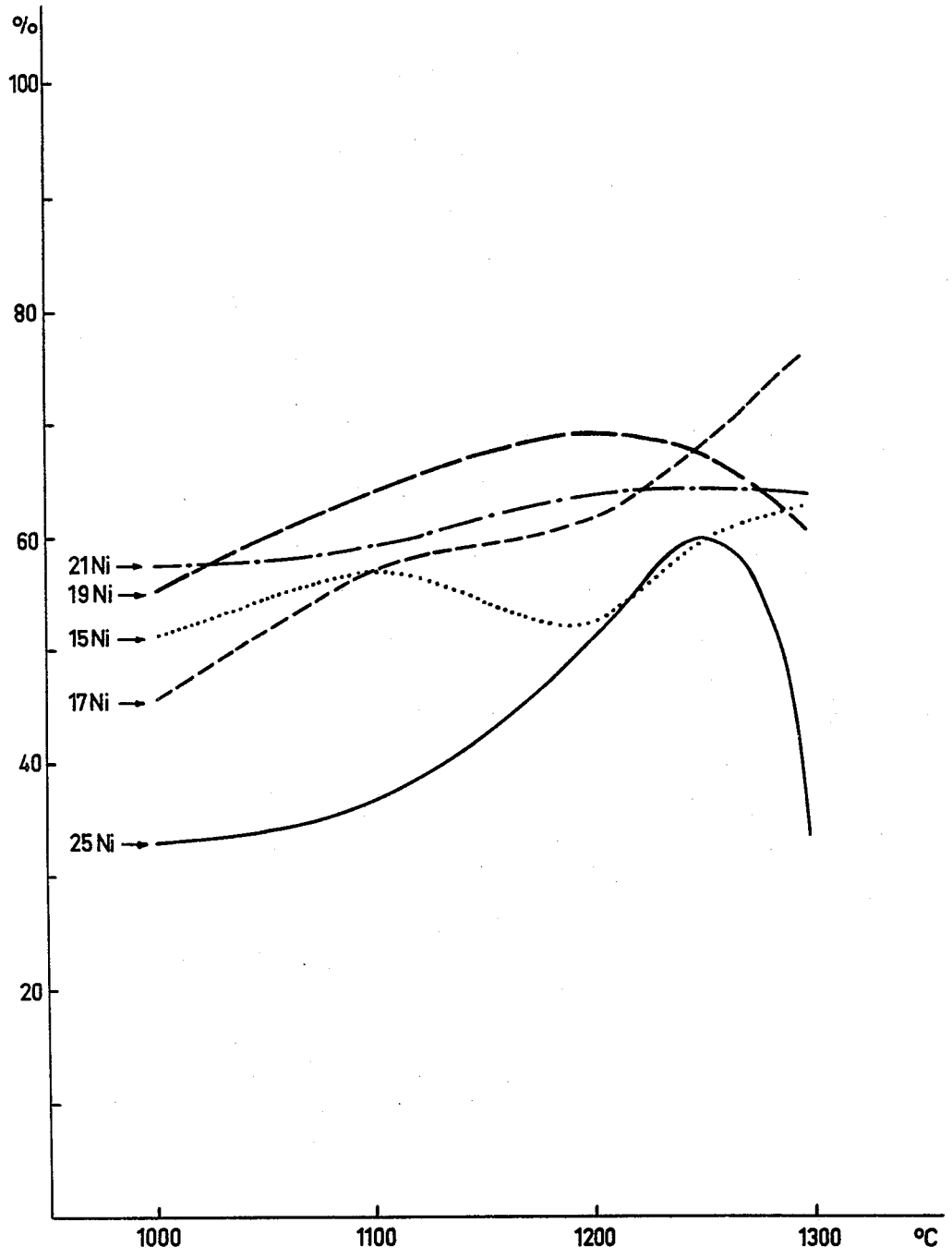

FIG. 2 shows the influence of Ni on the hot ductility of steel containing 20% Cr, 6% Mo and 0.1% N. It is clearly apparent from the diagram that a lowering of the Ni-content from 25% to below 20% results in a marked improvement of hot ductility. By a lower Ni-content both the absolute level and the temperature interval, within which the material can be worked, are improved. Even when considering an unavoidable spread of the results, there is a clear general tendency to a better hot ductility when the Ni-content is lowered from 25% to 15–21%.

The solidification tests carried out in parallel (see Table 1) explain this tendency thereby that a decreasing Ni-content is accompanied by a transition from austenitic solidification with substantial segregations and grain boundary precipitations to ferritic/austenitic solidification with less segregations and grain boundary precipitations. For a steel containing 20% Cr and 6–9% Mo an optimum Ni-content of about 17–21% seems to exist at which the hot ductility is highest. By adjusting the Ni-content according to the invention to a lower optimum level than in the conventional stainless steels with high Mo-content, a ferritic/austenitic solidification is obtained which yields for these steels a hot working structure with less rejects. Extensive studies of phase diagrams show that steels with Ni-contents stated according to the invention can be given a fully austenitic structure after annealing at 1050°–1150° C by alloying with nitrogen in contents varying between 0.06 and 0.25%, preferably 0.06 and 0.22%.

The stainless steel according to the present invention, thus, can be produced by a fully conventional process, including melting in a usual steel furnace, casting in ingots, breaking down the casting structure by rolling or forging, continued hot or cold working to sheet metal or bars, and annealing and pickling.

The Tables 3 and 4 show examples of the properties of steels according to the present invention, which are produced according to the method described above, compared with conventional steels.

Table 1

| | Solidification process of Cr-Ni-Mo steels with varying analysis | | | | | |
|---|---|---|---|---|---|---|
| Alloy No. | % Si | % N | % Cr | % Ni | % Mo | Type of solidification from melt |
| 1 | 0.40 | 0.006 | 20.0 | 23.7 | 0.02 | Fully austenitic |
| 2 | " | 0.037 | " | " | " | " |
| 3 | 0.40 | 0.069 | " | " | " | Fully austenitic |
| 4 | " | 0.124 | " | " | " | " |
| 5 | 0.40 | 0.005 | 20.4 | 15.7 | 2.88 | Primarily austenitic |
| 6 | " | 0.14 | 20.4 | 15.7 | 2.88 | " |
| 7 | 0.40 | 0.005 | 20.3 | 21.0 | 3.08 | Fully austenitic |
| 8 | " | 0.073 | 20.3 | 21.0 | 3.08 | " |
| 9 | 0.45 | 0.011 | 20.0 | 24.3 | 2.66 | Fully austenitic |
| 10 | " | 0.049 | 20.0 | 24.3 | 2.66 | " |
| 11 | 0.45 | 0.069 | 20.0 | 24.3 | 2.66 | Fully austenitic |
| 12 | " | 0.151 | 20.0 | 24.3 | 2.66 | " |
| 13 | 0.40 | 0.10 | 18.9 | 16.0 | 6.41 | Primarily ferritic |
| 14 | " | 0.005 | 20.4 | 16.0 | 6.26 | " |
| 15 | 0.40 | 0.09 | 20.4 | 16.0 | 6.26 | Primarily ferritic |
| 16 | " | 0.005 | 20.4 | 18.0 | 6.17 | " |
| 17 | 0.40 | 0.09 | 20.4 | 18.0 | 6.17 | Primarily austenitic |
| 18 | " | 0.08 | 18.9 | 21.4 | 6.25 | " |
| 19 | 0.40 | 0.005 | 20.3 | 21.4 | 6.26 | Primarily austenitic |
| 20 | " | 0.11 | 20.3 | 21.4 | 6.26 | |
| 21 | 0.42 | 0.005 | 19.8 | 22.5 | 5.86 | " |
| 22 | " | 0.07 | 19.8 | 22.5 | 5.86 | Fully austenitic |
| 23 | 0.43 | 0.01 | 20.0 | 24.8 | 5.74 | Primarily austenitic |
| 24 | " | 0.04 | 20.0 | 24.8 | 5.74 | Fully austenitic |
| 25 | 0.43 | 0.07 | 20.0 | 24.8 | 5.74 | " |
| 26 | " | 0.15 | 20.0 | 24.8 | 5.74 | Fully austenitic |
| 27 | 0.32 | 0.005 | 19.7 | 10.4 | 10.3 | Fully ferritic |
| 28 | 0.36 | 0.005 | 19.6 | 15.2 | 9.8 | " |
| 29 | 0.4 | 0.094 | 19.8 | 15.4 | 10.0 | Primarily ferritic |
| 30 | " | 0.14 | 19.8 | 18.3 | 10.0 | " |
| 31 | 0.4 | 0.005 | 20.0 | 20.0 | 9.0 | Primarily austenitic |
| 32 | 0.6 | 0.005 | 20.2 | 20.4 | 9.8 | " |
| 33 | 0.22 | 0.005 | 20.8 | 21.3 | 9.92 | Primarily austenitic |
| 34 | " | 0.092 | 20.8 | 21.3 | 9.92 | " |
| 35 | 0.49 | 0.007 | 19.6 | 25.3 | 8.64 | Primarily austenitic |
| 36 | " | 0.023 | 19.6 | 25.3 | 8.64 | " |
| 37 | 0.49 | 0.046 | 19.6 | 25.3 | 8.64 | Primarily austenitic |
| 38 | " | 0.156 | 19.6 | 25.3 | 8.64 | " |

Table 1-continued

Solidification process of Cr-Ni-Mo steels with varying analysis

| Alloy No. | % Si | % N | % Cr | % Ni | % Mo | Type of solidification from melt |
|---|---|---|---|---|---|---|
| 39 | 0.44 | 0.157 | 20.6 | 25.8 | 8.95 | Primarily austenitic |
| 40 | 0.42 | 0.005 | 18.4 | 30.5 | 9.3 | Fully austenitic |
| 41 | " | 0.005 | 17.3 | 33.5 | 9.6 | " |
| 42 | 0.40 | 0.03 | 10.9 | 25.2 | 10.8 | Primarily austenitic |
| 43 | 0.48 | 0.03 | 15.7 | 25.8 | 10.3 | " |
| 44 | 0.45 | 0.03 | 16.9 | 25.4 | 9.9 | Primarily austenitic |
| 45 | 0.11 | 0.005 | 19.9 | 25.7 | 10.1 | " |
| 46 | 1.19 | 0.005 | 20.0 | 29.7 | 9.5 | Primarily austenitic |

Table 2

List of charge analyses for alloys subjected to tensile test at elevated temperatures

| Alloy No. | % C | % Cr | % Ni | % Mo | % N | other |
|---|---|---|---|---|---|---|
| 51 | 0.015 | 20.1 | 24.8 | 3.2 | 0.055 | |
| 52 | 0.020 | 20.2 | 24.8 | 5.9 | 0.062 | |
| 53 | 0.011 | 17.5 | 24.2 | 6.0 | 0.054 | |
| 54 | 0.013 | 22.9 | 25.2 | 6.3 | 0.063 | |
| 55 | 0.018 | 22.7 | 25.1 | 6.2 | 0.063 | Ce |
| 56 | 0.019 | 20.3 | 25.0 | 5.7 | 0.109 | |
| 57 | 0.028 | 20.7 | 24.5 | 5.7 | 0.154 | |
| 58 | 0.018 | 20.2 | 25.5 | 8.5 | 0.053 | |
| 59 | 0.016 | 18.2 | 25.4 | 8.7 | 0.049 | |
| 60 | 0.012 | 19.5 | 24.8 | 9.2 | 0.060 | Ce |
| 61 | 0.019 | 20.3 | 25.5 | 8.8 | 0.108 | |
| 62 | 0.013 | 20.6 | 25.6 | 8.8 | 0.145 | |
| 63 | 0.018 | 20.6 | 25.8 | 9.0 | 0.157 | Ce |
| 64 | 0.016 | 19.1 | 20.6 | 9.1 | 0.033 | |
| 65 | 0.015 | 19.5 | 20.5 | 6.3 | 0.096 | |
| 66 | 0.017 | 20.2 | 16.9 | 6.3 | 0.040 | |
| 67 | 0.015 | 20.2 | 17.3 | 6.2 | 0.093 | |
| 68 | 0.015 | 20.3 | 17.1 | 6.3 | 0.149 | |
| 69 | 0.014 | 20.4 | 15.2 | 6.4 | 0.040 | |

Table 2-continued

List of charge analyses for alloys subjected to tensile test at elevated temperatures

| Alloy No. | % C | % Cr | % Ni | % Mo | % N | other |
|---|---|---|---|---|---|---|
| 70 | 0.013 | 20.2 | 15.3 | 6.3 | 0.090 | |
| 71 | 0.015 | 20.2 | 15.1 | 6.4 | 0.136 | |
| 72 | 0.013 | 20.2 | 15.4 | 9.3 | 0.038 | |
| 73 | 0.013 | 20.2 | 35.8 | 8.7 | 0.040 | |
| 74 | 0.016 | 19.4 | 20.1 | 6.0 | 0.049 | |
| 75 | 0.013 | 19.8 | 18.7 | 6.0 | 0.052 | |
| 76 | 0.014 | 19.9 | 18.9 | 6.1 | 0.050 | |
| 77 | 0.013 | 20.0 | 18.9 | 6.2 | 0.088 | |
| 78 | 0.015 | 19.6 | 17.3 | 6.1 | 0.030 | Co |

Table 3

Pitting potentials for austenitic stainless steels in 1M NaCl with varying Molybdenum contents.

| No | Alloy type | C | Si | Mn | Cr | Ni | Mo | Cu | N | mV/SCE 50° C | 70° C | 90° C |
|---|---|---|---|---|---|---|---|---|---|---|---|---|
| A | 316 L | 0.030 | 0.5 | 1.5 | 17.5 | 13.0 | 2.7 | 0.1 | 0.050 | 100 | | |
| B | 317 L | 0.030 | 0.5 | 1.5 | 18.5 | 14.5 | 3.5 | 0.1 | 0.10 | 330 | | |
| C | 20/25/4,5Cu | 0.018 | 0.46 | 1.55 | 20.3 | 24.7 | 4.4 | 1.62 | 0.033 | 420 | | |
| D | 20/25/6 | 0.037 | 0.81 | 1.81 | 20.5 | 24.6 | 6.3 | 0.10 | 0.040 | 885 | | |
| E | 20/25/6Cu | 0.020 | 0.38 | 1.51 | 20.2 | 24.4 | 5.7 | 1.62 | 0.129 | 950 | 375 | |
| F | 20/25/8Cu | 0.028 | 0.48 | 1.52 | 20.8 | 24.4 | 8.2 | 1.60 | 0.311 | 950 | | |
| G | 18/35/8Cu | 0.013 | 0.28 | 0.26 | 17.6 | 34.8 | 8.3 | 1.45 | 0.006 | 945 | | |
| H | 20/18/6 | 0.026 | 0.43 | 0.89 | 20.2 | 18.0 | 6.3 | 0.06 | 0.095 | 835 | 820 | 385 |
| I | 20/18/6Cu | 0.034 | 0.45 | 0.89 | 20.1 | 18.3 | 6.4 | 0.99 | 0.090 | 945 | 860 | 520 |
| J | 20/18/6 low Mn | 0.013 | 0.36 | 0.57 | 19.7 | 18.3 | 6.2 | 1.01 | 0.192 | | 900 | 640 |
| K | 20/18/6 low Cu, low Mn | 0.014 | 0.47 | 0.47 | 19.5 | 18.3 | 6.0 | 0.53 | 0.205 | | 925 | 540 |
| L | 20/20/7,5 low Mn | 0.013 | 0.41 | 0.52 | 19.9 | 20.2 | 7.4 | 0.55 | 0.196 | | 925 | 800 |

As appears from the Table, molybdenum has a strong positive effect on the pitting potential. The alloys A-B are acid-resistant standard steels with moderate molybdenum contents and comparatively low pitting potentials. The group C-G comprises steels with high Mo- and Ni-contents and high pitting potentials. The alloys H-L are steels according to the present invention characterized by comparatively low Ni-contents. The pitting potentials of these latter steels are fully on the same level as those for the steels having high Ni-contents.

Table 4

Corrosion rates in some acids a) Technical phosphoric acid 80° C

| No | Alloy type | C | Si | Mn | Cr | Ni | Mo | Cu | N | Electrochemical condition |
|---|---|---|---|---|---|---|---|---|---|---|
| B | 317 L | 0.030 | 0.5 | 1.5 | 18.5 | 14.5 | 3.5 | 0.0 | 0.10 | active |
| C | 10/25/4,5Cu | 0.013 | 0.27 | 1.62 | 21.8 | 23.9 | 4.4 | 1.3 | 0.040 | instable passive |
| H | 20/18/6 | 0.026 | 0.43 | 0.89 | 20.2 | 18.0 | 6.3 | 0.1 | 0.095 | stable passive |
| I | 20/18/6Cu | 0.034 | 0.45 | 0.89 | 20.1 | 18.3 | 6.4 | 1.0 | 0.090 | stable passive |

p b) 20 % sulphuric acid 70° C

| | | | | | | | | | | 1[x] | 11[xx] |
|---|---|---|---|---|---|---|---|---|---|---|---|
| A | 316 | 0.039 | 0.40 | 1.58 | 16.8 | 11.6 | 2.7 | 0.12 | 0.041 | active | active |
| B | 317 | 0.032 | 0.36 | 1.82 | 18.9 | 14.4 | 3.6 | 0.16 | 0.120 | instable passive | instable passive |
| C | 20/25/4,5Cu | 0.013 | 0.27 | 1.62 | 21.8 | 23.9 | 4.9 | 1.3 | 0.040 | passive | instable passive |
| H | 20/18/6 | 0.026 | 1.43 | 0.89 | 20.2 | 18.0 | 6.3 | 0.1 | 0.095 | passive | stable passive |
| I | 20/18/6Cu | 0.034 | 0.45 | 0.89 | 20.1 | 18.3 | 6.4 | 1.0 | 0.090 | passive | stable passive |

[x]prior to activation
[xx]after activation in HCl

The Table indicates that steels according to the present invention are stable passive in test acids while the commercial steels are instable passive or active. The stable passive condition implies most often corrosion rates below 0.1 mm/year.

What we claim is:

1. An austenitic stainless steel alloy having good hot workability and pit corrosion resistance, consisting essentially of about 6% to 10% molybdenum, 17% to 25% chromium, 15% to 21% nickel, up to 0.080% carbon, 0.2% to 2% manganese, 0.1% to 0.8% silicon, 0% to 2% copper, 0.06% to 0.25% nitrogen, and the remainder essentially being all iron, wherein the nickel content is adjusted in relation to the other aforementioned elements in order that the alloy is solidified from is melt phase a ferrite-austenite and wherein the contents of said alloy satisfy the equation:

$$1.2 < \frac{\%Cr + \%Mo + 1.5\% Si}{\%Ni + 0.5(\%Cu + \%Mn) + 30\% C + 10\% N} < 1.6$$

2. An alloy according to claim 1 having from about 0.005% to 0.030% carbon, 0.2% to 1.0% manganese, 0.3% to 0.5% silicon, 0.06% to 0.22% nitrogen, 17.0% to 25.0% chromium, 6.0% to 10.0% molybdenum, 0.4% to 1.2% copper and 15.0% to 21.0% nickel.

3. An alloy according to claim 1, wherein cerium is present in an amount no greater than about 0.10% and originating from the addition of mish metal to the alloy melt phase.

4. An alloy according to claim 3, wherein the amount of cerium is from about 0.01% to 0.06%.

5. An alloy according to claim 1, wherein either or both of the elements aluminum and boron is (are) present in the amount of about 0.01% to 0.3% and 0.0001% to 0.01%, respectively.

6. An alloy according to claim 3, wherein either or both of the elements aluminum and boron is (are) present in the amount of about 0.01% to 0.3% and 0.0001% to 0.1%, respectively.

7. An alloy according to claim 1, wherein one or more of the carbide forming elements Nb, Ta, Ti, V, W and Zr is (are) present in a total amount up to 1.0%.

8. An alloy according to claim 3, wherein one or more of the carbide forming elements Nb, Ta, Ti, V, W and Zr is (are) present in a total amount up to 1.0%.

9. An alloy according to claim 5, wherein one or more of the carbide forming elements Nb, Ta, Ti, V, W and Zr is (are) present in a total amount up to 1.0%.

* * * * *

UNITED STATES PATENT OFFICE

CERTIFICATE OF CORRECTION

Patent No. 4,078,920 Dated March 14, 1978

Inventor(s) Mats Liljas, Jan Ingemar Fridberg & Hasse Sigverd Fredriksson

It is certified that error appears in the above-identified patent and that said Letters Patent are hereby corrected as shown below:

First page, item [21], "Application Serial No. 763,598" should read -- Application Serial No. 763,508 --;
second column, under "References Cited", fifth reference "Forbos-Jones" should read -- Forbes Jones --.
Column 1, line 48, "δ" should be -- σ --;
line 49, "δ" should be -- σ --;
line 50, "δ" should be -- σ --;
line 52, "δ" should be -- σ --.
Column 2, line 13, "0.06-p39p p31p p38p" should read -- 0.06-0.25%N 0.06-0.22% --;
line 14, "17--0.25%N 0.06-0.22%" should be deleted;
lines 25-27, equation should read $$-- \; 1.2 < \frac{\%Cr + \%Mo + 1.5\% \; Si}{\%Ni + 0.5(\%Cu + \%Mn) + 30\% \; C + 10\% \; N} < 1.6 \; --.$$

Column 6, line 9 of Table 4, delete "p".
Column 7, line 7, change "is" to -- its -- and change "a" to -- as --.

Signed and Sealed this

Fifteenth Day of August 1978

[SEAL]

Attest:

RUTH C. MASON
Attesting Officer

DONALD W. BANNER
Commissioner of Patents and Trademarks